United States Patent [19]

Young et al.

[11] Patent Number: 4,461,739

[45] Date of Patent: Jul. 24, 1984

[54] CONTINUOUS LIQUID PHASE PROCESS FOR MELT SPINNING ACRYLONITRILE POLYMER

[75] Inventors: Chi C. Young; Francesco De Maria, both of Gulf Breeze, Fla.

[73] Assignee: American Cyanamid Company, Stamford, Conn.

[21] Appl. No.: 457,783

[22] Filed: Jan. 13, 1983

[51] Int. Cl.[3] ..... D01F 6/00

[52] U.S. Cl. ..... 264/176 F; 264/206

[58] Field of Search ..... 264/206, 176 F

[56] References Cited

U.S. PATENT DOCUMENTS

| | | | |
|---|---|---|---|
| 2,585,444 | 2/1952 | Coxe | 264/182 |
| 3,873,508 | 3/1975 | Turner | 264/206 |
| 4,049,605 | 9/1977 | Kobashi et al. | 264/206 |
| 4,062,857 | 12/1977 | Kobashi et al. | 264/206 |
| 4,094,948 | 6/1978 | Blickenstaff | 264/206 |
| 4,108,818 | 8/1978 | Odawara et al. | 264/206 |
| 4,163,770 | 8/1979 | Porosoff | 264/206 |
| 4,166,091 | 8/1979 | Beebe | 264/206 |
| 4,238,441 | 12/1980 | Cramer | 264/206 |
| 4,238,442 | 12/1980 | Cline et al. | 264/206 |

*Primary Examiner*—Jay H. Woo

*Attorney, Agent, or Firm*—Frank M. Van Riet

[57] ABSTRACT

A process for preparing fibers from acrylonitrile polymer via melt spinning is disclosed wherein a slurry of polymer, water and surfactant are evaporated to form a single phase homogeneous melt of less than about 25 weight percent water and in the range from about 12 to 20 percent.

7 Claims, No Drawings

CONTINUOUS LIQUID PHASE PROCESS FOR MELT SPINNING ACRYLONITRILE POLYMER

BACKGROUND OF THE INVENTION

In the production of polymers of acrylonitrile useful in the formation of fibers by melt-spinning, the prior art procedures have comprised formation of the polymer by polymerization of the monomer, such as taught by Mallison in U.S. Pat. No. 2,847,405. A polymer crumb is formed, stripped, washed and dried to a low moisture level for ultimate fiber formation.

The drying of the polymer crumb is normally conducted after the polymer recovered from the polymer washing zone has undergone a series of treatments such as additive blending, compounding, pelletizing etc. The crumb, in the form of pellets, is normally dried on a belt drier and then conveyed to a suitable storage area or directly to the melt-spinning facility. The steam generated during the crumb drying is vented and lost.

Before spinning, the moisture in the polymer is normally adjusted by blending therewith the required amount of water, to obtain about 15 weight percent. The resultant mixture of polymer and water remains as a powder and must be formed into a melt before spinning can be accomplished.

U.S. Pat. No. 3,991,153 discloses a method for forming the polymer melt which is ultimately formed into fibers whereby the wetted polymer containing up to about 35–40 weight percent of water is compressed and melted in an extrusion zone with the aid of a porous plug which prevents the escape of vaporized water. U.S. Pat. No. 4,283,365 is an improvement on the above-patented extrusion process and comprises the use of a vertically disposed compression zone. While generally effective, both of these systems still require the handling of a delicate pellet, the close control of moisture and the proper extrusion procedure.

U.S. Pat. No. 3,847,885 avoids some of the problems attributed to the above systems in that it discloses the creation of a polymer melt in an excess of water, however, the procedure requires that the system again be cooled. A reverse solidification of the polymer results with the hope that the required, critical amount of water will remain entrapped therein.

Each of the above procedures involves difficulties and undesirable features which, if eliminated, would solve a long-felt need and result in considerable savings in both energy and handling.

SUMMARY OF THE INVENTION

It has now been found that the difficulties presented by the extrusion and solids handling procedures of the prior art can be overcome if the polymer slurry recovered from the polymer washing steps is fed directly into a high pressure evaporator. Utilizing the process of the present invention, many solid handling and preparation steps as well as apparatus such as silos and conveyors are eliminated, air bubbles which form during extrusion are also eliminated and oxygen contact with the polymer during polymer melting which causes color formation, cross-linking and cyclization therein is reduced. Furthermore, steam generated during the water evaporation can be reused by recycling it to the solidification zone of the melt-spinning operation.

DESCRIPTION OF THE INVENTION INCLUDING PREFERRED EMBODIMENTS

The process of the present invention for preparing an acrylonitrile polymer fiber comprises continuously feeding a slurry of at least about 10%, preferably 20%–30%, of fiber-forming acrylonitrile solids and water, said slurry containing from about 0.0 to about 3.0 weight percent, preferably from about 0.1 to about 0.3, weight percent, of a cationic surfactant, into an evaporator at a pressure of from about 30 to about 150 psig. Preferably from about 60 to about 100 psig., a temperature such that said slurry is gradually formed into a single phase homogeneous melt and the water thereof is continuously evaporated therefrom to result in the reduction of water in said melt to less than about 25% weight percent, preferably from about 12 to about 20 weight percent, and for such a time that said polymer is not degraded, recovering a single phase homogeneous polymer melt of reduced water content and passing the same through a spinnerette assembly directly into a steam pressurized solidification zone maintained under conditions which control release of water from the nascent filaments formed to thereby prevent degradation thereof. The temperature and residence time should be determined for each individual polymer beforehand since the decomposition of the polymer is a function of both the temperature and residence time. The higher the temperature, the shorter the residence time which can be tolerated before the onset of degradation. In general, however reaction times ranging from about 2–20 minutes and temperatures ranging from about 160°–210° C. may be used.

As can be readily appreciated, the above process is an all fluid process and, as such, no solid formation or handling problems exist. The polymer which exits from the polymerization reactor can be washed of all impurities as usual. The resultant polymer water slurry can then be adjusted to the desired solids content, after addition of non-volatile additives such as the cationic surfactant, and fed directly to the evaporator.

Any fiber-forming acrylonitrile polymer may be used in conjunction with water in the process of the present invention to form the slurry which is processed into the single phase homogeneous melt. Such polymers are well known in the art and can be ascertained from a perusal of the above-cited U.S. patents. Preferred polymers are those which contain at least about 50 weight percent of acrylonitrile and at least 1 weight percent of a comonomer copolymerizable therewith.

The proper amount of water necessary to provide the single phase homogeneous melt will generally comprise less than about 25 weight percent. However, from about 12 to about 20 weight percent has been found effective, with the exact proportions necessary, depending upon the specific polymer involved, being readily ascertainable from an appropriate phase diagram and the operating conditions of the evaporator.

Any evaporator which functions within the above-enumerated pressure range can be utilized in the process of the present invention. A multiple screw devolatizing apparatus such as a "disk pack" type or an Atlantic® reactor, may be efficiently employed. A preferred apparatus, however, is a wiped film evaporator or compounding machine wherein the slurry is picked up by rotor blades and distributed on the heated wall of the apparatus as a thin film. The film is continuously mixed and a new surface is made with each pass of the rotor blades, thereby promoting high heat and mass transfer rates. The polymer-water mixture forms into a melt which is transported in a helical flow pattern to the discharge end of the apparatus. The constant clearance between the heated wall and the rotor blades results in a constant shear rate, causing the excess water to be driven off and removed from the top of the apparatus.

Any known cationic surfactant may be used in the process of the present invention in the amounts specified above. Exemplary, but not all-inclusive, surfactants useful herein include those cationic surfactants having the general formula

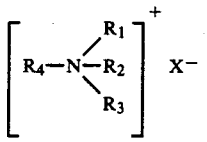

wherein $R_1$, $R_2$, and $R_3$ are, individually, alkyl groups of 1–4 carbon atoms inclusive, $R_4$ is a $C_{10}$–$C_{18}$ alkyl group and $X^-$ is any strong acid anion. Exemplary cationic surfactants include trimethyl dodecyl ammonium chloride; trimethyl cocoa ammonium chloride and the like.

The following examples are set forth for purposes of illustration only and are not to be construed as a limitation on the present invention except as set forth in the appended claims. All parts and percentages are by weight unless otherwise specified.

EXAMPLE 1

The acrylonitrile polymer change is a grafted copolymer in which 84.1 parts acrylonitrile, 11.9 parts methyl methacrylate were polymerized in the presence of 3.5 parts of polyvinyl alcohol. The polymer has a kinematic molecular weight average of 41,900 [kinematic molecular weight average ($M_k$) is obtained from the relationship $$u = \frac{1}{A} M_k$$

wherein u is the average effluent time in seconds for a solution of 1 gram of the polymer in 100 millileters of 50 weight percent aqueous sodium thiocyanate solvent at 40° multiplied by the viscometer factor and A is the solution factor derived from a polymer of known molecular weight].

The polymer is washed and centrifuged. A slurry containing 30% polymer solids and 0.25% trimethyl cocoa ammonium chloride in water is then prepared in a suitable feed tank. The tank is agitated and jacketed. A recirculation line is added to prevent slurry from settling to the bottom of the feed tank.

The polymer slurry is preheated to 60° C. and the charge is fed to a commercially available Luwa Corp. Filmtruder ® where the excess water is evaporated and spinnable melt is formed. The following table shows the operating conditions.

| FILMTRUDER ® OPERATING CONDITIONS | | | FEED | | | | MELT DISCHARGE | | STEAM PRODUCED |
|---|---|---|---|---|---|---|---|---|---|
| ROTOR SPEED rpm | PRESSURE psig | JACKET TEMP °C. | MELT TEMP °C. | RATE lb/hr | SOLIDS % | TEMP °C. | RATE lb/hr | SOLIDS % | RATE lb/hr |
| 350 | 74 | 205/202 | 171 | 114 | 30 | 62 | 39 | 87 | 75 |

The melt discharge is continuously fed to an extruder and extruded through a spinnerette directly into a steam pressurized solidification zone maintained under about 23 psig with saturated steam. Stretching of the filaments is accomplished in two stages therein and fine quality fiber is continuously recovered.

EXAMPLE 2

The procedure of Example 1 is again followed except that the Filmtruder ® is replaced with a multiple-screw devolatilizer. Excellent results are achieved.

EXAMPLE 3

The procedure of Example 1 is again followed. Steam recovered from the evaporator is recycled to the solidification zone. Again, excellent fiber is recovered.

We claim:

1. A process for preparing acrylonitrile polymer fiber which comprises continuously feeding a slurry of at least about 10% of fiber-forming, washed acrylonitrile polymer solids and water, said slurry also containing from about 0.0 to about 3 weight percent of a cationic surfactant, into an evaporator at a pressure of from about 30 to about 150 psig, a temperature such that said slurry is gradually formed into a single phase homogeneous melt and the water thereof is continuously evaporated therefrom to result in the reduction of water in said melt to less than about 25 weight percent, and for such a time that said polymer is not degraded, recovering a single phase homogeneous polymer melt of reduced water content and passing the same through a spinnerette assembly directly into a steam pressurized solidification zone maintained under conditions which control release of water from the nascent filaments formed to thereby prevent degradation thereof and recovering the resultant fiber.

2. A process according to claim 1 wherein the slurry contains from about 0.1 to about 0.3, weight percent, of said cationic surfactant.

3. A process according to claim 1 wherein the pressure in said evaporator ranges from about 60 to 100 psig.

4. A process according to claim 1 wherein the water in said melt is reduced to from about 12 to 20 weight percent in said evaporator.

5. A process according to claim 1 wherein said slurry contains from about 20–30% of polymer solids.

6. A process according to claim 1 wherein said evaporator is a thin film evaporator.

7. The process of claim 1 wherein steam is removed from said evaporator and recycled to said solidification zone.

* * * * *